US011158144B2

(12) United States Patent
Friedli

(10) Patent No.: US 11,158,144 B2
(45) Date of Patent: Oct. 26, 2021

(54) ACCESS CONTROL SYSTEM HAVING AUTOMATIC STATUS UPDATE

(71) Applicant: INVENTIO AG, Hergiswil (CH)

(72) Inventor: Paul Friedli, Remetschwil (CH)

(73) Assignee: Inventio AG

( * ) Notice: Subject to any disclaimer, the term of this patent is extended or adjusted under 35 U.S.C. 154(b) by 0 days.

(21) Appl. No.: 16/461,126

(22) PCT Filed: Nov. 9, 2017

(86) PCT No.: PCT/EP2017/078790
§ 371 (c)(1),
(2) Date: May 15, 2019

(87) PCT Pub. No.: WO2018/091354
PCT Pub. Date: May 24, 2018

(65) Prior Publication Data

US 2019/0371101 A1 Dec. 5, 2019

(30) Foreign Application Priority Data

Nov. 15, 2016 (EP) ..... 16198977

(51) Int. Cl.
*G07C 9/00* (2020.01)
*G07C 9/38* (2020.01)

(52) U.S. Cl.
CPC ..... *G07C 9/00309* (2013.01); *G07C 9/00571* (2013.01); *G07C 9/38* (2020.01);
(Continued)

(58) Field of Classification Search
CPC .. G07C 9/00309; G07C 9/38; G07C 9/00571; G07C 2009/00341; G07C 2009/0042; G07C 2209/62
See application file for complete search history.

(56) References Cited

U.S. PATENT DOCUMENTS 9,077,716 B2 7/2015 Myers et al.
10,264,433 B2 * 4/2019 Ahearn ..... H04W 12/06
(Continued)

FOREIGN PATENT DOCUMENTS

CN 103971435 A 8/2014
CN 204390327 U 6/2015
(Continued)

*Primary Examiner* — Nabil H Syed
(74) *Attorney, Agent, or Firm* — Bressler, Amery and Ross; Pierre R. Yanney

(57) ABSTRACT

A mobile electronic device receives a data signal with a lock identifier and a lock state designator when it is in radio range of the electronic lock. The mobile device generates a server message which comprises the lock identifier, the lock state designator and a device identifier. The mobile electronic device sends the server message to the data processing device which stores a state of the electronic lock based on an evaluation of the lock state designator. The data processing device generates a confirmation message which contains an electronic code to activate the electronic lock when the electronic lock is in an inactive state and the device identifier in the user file is assigned to the lock identifier and which contains a user message when the electronic lock is in the active state or the user has no access authorization to the access-restricted zone assigned to the electronic lock.

16 Claims, 3 Drawing Sheets

(52) U.S. Cl.
CPC ..... *G07C 2009/0042* (2013.01); *G07C 2009/00341* (2013.01); *G07C 2209/62* (2013.01)

(56) References Cited

U.S. PATENT DOCUMENTS

| | | | | |
|---|---|---|---|---|
| 2012/0300927 | A1 | 11/2012 | Choi | |
| 2014/0049364 | A1 | 2/2014 | Ahearn et al. | |
| 2014/0051407 | A1 | 2/2014 | Ahearn et al. | |
| 2014/0292481 | A1 | 10/2014 | Dumas et al. | |
| 2016/0260271 | A1* | 9/2016 | Belhadia ..... | H04W 12/06 |

FOREIGN PATENT DOCUMENTS

| | | | |
|---|---|---|---|
| CN | 105005862 | A | 10/2015 |
| CN | 105139499 | A | 12/2015 |
| CN | 105427428 | A | 3/2016 |
| CN | 107181742 | A | 9/2017 |
| EP | 1536382 | A2 | 6/2005 |
| EP | 1562153 | A2 | 8/2005 |
| EP | 1562153 | A3 | 4/2006 |
| EP | 1868857 | B1 | 10/2008 |
| EP | 2977964 | A1 | 1/2016 |
| WO | 2006112274 | A1 | 10/2006 |
| WO | 2006136662 | A1 | 12/2006 |
| WO | 2011159921 | A1 | 12/2011 |
| WO | 2013078561 | A1 | 6/2013 |
| WO | 2014007870 | A1 | 1/2014 |
| WO | 2016139528 | A1 | 9/2016 |

* cited by examiner

ACCESS CONTROL SYSTEM HAVING AUTOMATIC STATUS UPDATE

CROSS-REFERENCE TO RELATED APPLICATIONS

This application is the national phase application under 35 U.S.C. § 371 claiming the benefit of priority based on International Patent Application No. PCT/EP2017/078790, filed on Nov. 9, 2017, which claims the benefit of priority based on European Patent Application No. 16198977.7, filed on Nov. 15, 2016. The contents of each of these applications are herein incorporated by reference.

FIELD OF THE INVENTION

The technology described here relates generally to an access control system for a building. Exemplary embodiments of the technology relate in particular to an access control system with an electronic lock which can be actuated by a mobile device and a method for operating such an access control system.

BACKGROUND OF THE INVENTION

In known exemplary access control systems, doors are fitted with electronic door locks. U.S. Pat. No. 9,077,716 for example describes an access control system in which a mobile device communicates with an electronic door lock by means of a Bluetooth or WLAN radio connection and with a web server by means of a WAN (wide area network) radio connection (e.g. GSM) in order to open the electronic lock. To this end the mobile device sends its device identifier and the identifier of the electronic lock to the web server which checks the access authorization and sends a coded response consisting of a lock command, the lock identifier and a code pattern to the mobile device. The mobile device checks whether the lock identifier is known and if this is the case, activates an opening button to be pressed by the user. If this is pressed within a specified time, the mobile device sends the lock command and the code pattern to the electronic lock. If the lock identifies the lock command and the code pattern as valid, it is opened and the web server receives a confirmation via the mobile device. If the lock is already open however, the web server contains an error message.

This access control system offers a certain user friendliness since the user need not carry a conventional key with him and note any access code. Instead, the mobile device which many users already carry with them for communication purposes in any case affords the function of a key. In order to enable this user friendliness, the access control system requires a complex communication process including the sending of a confirmation or error message to the web server depending on whether the door was closed or open. There is therefore a need for a different, less complex technology.

SUMMARY OF THE INVENTION

One aspect of such technology relates to an access control system comprising an electronic lock and a data processing device. The electronic lock is arranged on an access-restricted zone, has an active and an inactive state and comprises a radio transceiver. The radio transceiver is configured to send a data signal to a mobile electronic device and receive an electronic code from the mobile electronic device, wherein the data signal comprises a lock identifier and a lock state designator. The data processing device contains a database which stores the state of the electronic lock and comprises a user file in which a user is assigned at least one access authorization to an access-restricted zone. The mobile electronic device is provided for communication with the electronic lock and the data processing device, wherein the mobile electronic device is assigned to the user and during operation generates a server message which comprises the lock identifier, the lock state designator and a device identifier of the mobile electronic device. The data processing device generates a confirmation message, which contains an electronic code for activating the electronic lock when the electronic lock is in the inactive state and the device identifier in the user file is assigned to the lock identifier, and which contains a user message when the electronic lock is in the active state or the user has no access authorization to the access-restricted zone assigned to the electronic lock.

A further aspect relates to a method for operating an access control system. In this access control system a mobile electronic device receives a data signal with a lock identifier and lock state designator when it is within radio range of the electronic lock. The mobile device generates a server message which comprises the lock identifier, the lock state designator and a device identifier of the mobile electronic device. The mobile electronic device sends the server message to the data processing device which stores a state of the electronic lock based on an evaluation of the lock state designator. The data processing device generates a confirmation message which contains an electronic code for activating the electronic lock when the electronic lock is in an inactive state and the device identifier in the user file is assigned to the lock identifier and which contains a user message when the electronic lock is in the active state or the user has no access authorization to the access-restricted zone assigned to the electronic lock.

The technology described here creates an access control system with an improved monitoring and updating of the state of an electronic lock. As soon as the mobile electronic device and the electronic lock come into radio contact, the mobile electronic device relays the lock state designator of the electronic lock to the data processing device. The data processing device then updates the state of this electronic lock in its database. In other words, therefore each electronic lock itself ensures that the database stores its current state. This process preferably takes place automatically without the user having to be active.

In order to be able to store the current state in the data processing device, the lock state designator is evaluated, for example, by a processor in the data processing device. The evaluation is thus made centrally in the data processing device so that the mobile electronic device can relay the state designator without evaluation.

The automatic state updating is advantageous if several persons are located in the building and for example are located on a floor near a door with an electronic lock or are passing by. If their mobile electronic devices come within the radio range of the electronic lock, each mobile electronic device generates a server message and sends it to the data processing device. After receiving each server message and evaluating the lock state designator contained therein, the data processing device stores the state of the electronic lock. Each mobile electronic device therefore contributes to the stored state of the electronic lock being up-to-date and specifically independently of whether its user wishes access to a door or not.

In one exemplary embodiment the mobile electronic device sends the confirmation message to the electronic lock when the electronic lock is in the inactive state and the device identifier in the user file is assigned to the lock identifier. The electronic lock is then activated when the electronic code of the confirmation message agrees with a reference code stored in the electronic lock. This is also accomplished in one exemplary embodiment without assistance of the user. As long as the mobile electronic device is located in the radio range of the electronic lock, it is not necessary for the user to make use of the mobile electronic device or move towards the electronic lock.

In a modification to the previous exemplary embodiment it can be provided in one exemplary embodiment that the user has to bring the mobile electronic device into the vicinity of the electronic lock when this lock is to be activated. In this exemplary embodiment the mobile electronic device sends the confirmation message to the electronic lock when the mobile electronic device is at a distance from the electronic lock which is shorter than a specified maximum distance. The electronic lock is activated when the electronic code of the confirmation message agrees with a reference code stored in the electronic lock. These alternatives regarding what the user has to do when access to a zone is desired, allow the access control system to adapt flexibly to the requirements in a building.

The technology described also allows flexibility with regard to the manner whether and how the user is to be informed. In one exemplary embodiment the information is accomplished by means of the mobile electronic device which the user carries with him. The mobile electronic device generates the notification based on the confirmation message. The notification can be presented visually and/or audibly, e.g. by means of at least one notification type, wherein the notification type is selected from a group comprising text, symbols, pictograms, speech, tones and sounds.

In one exemplary embodiment, the confirmation message contains, in addition to the electronic code, a further electronic code which is stored in the electronic lock and is valid for a future activation of the electronic lock. The further electronic code constitutes the reference code for the future activation. This enables a flexible choice of a desired security level. If a high security level is desired, the electronic code can only be used once on the electronic lock. If the electronic lock is to be activated again thereafter, the electronic code sent with the confirmation message must then correspond to the further electronic code (reference code). If a lower security level is desired, the reference code can be replaced, for example, after a certain usage time or after a certain number of activations of the electronic lock by the further electronic code.

In one exemplary embodiment the radio communication between the mobile electronic device and the electronic lock is based on a Bluetooth standard. In particular smartphones are fitted with this radio technology so commercially available devices can be used for the technology described here.

BRIEF DESCRIPTION OF THE DRAWINGS

Various aspects of the improved technology are explained in detail hereinafter with reference to exemplary embodiment in conjunction with the figures. In the figures the same elements have the same reference numbers. In the figures.

DETAILED DESCRIPTION OF EMBODIMENTS OF THE INVENTION

Figure 1:
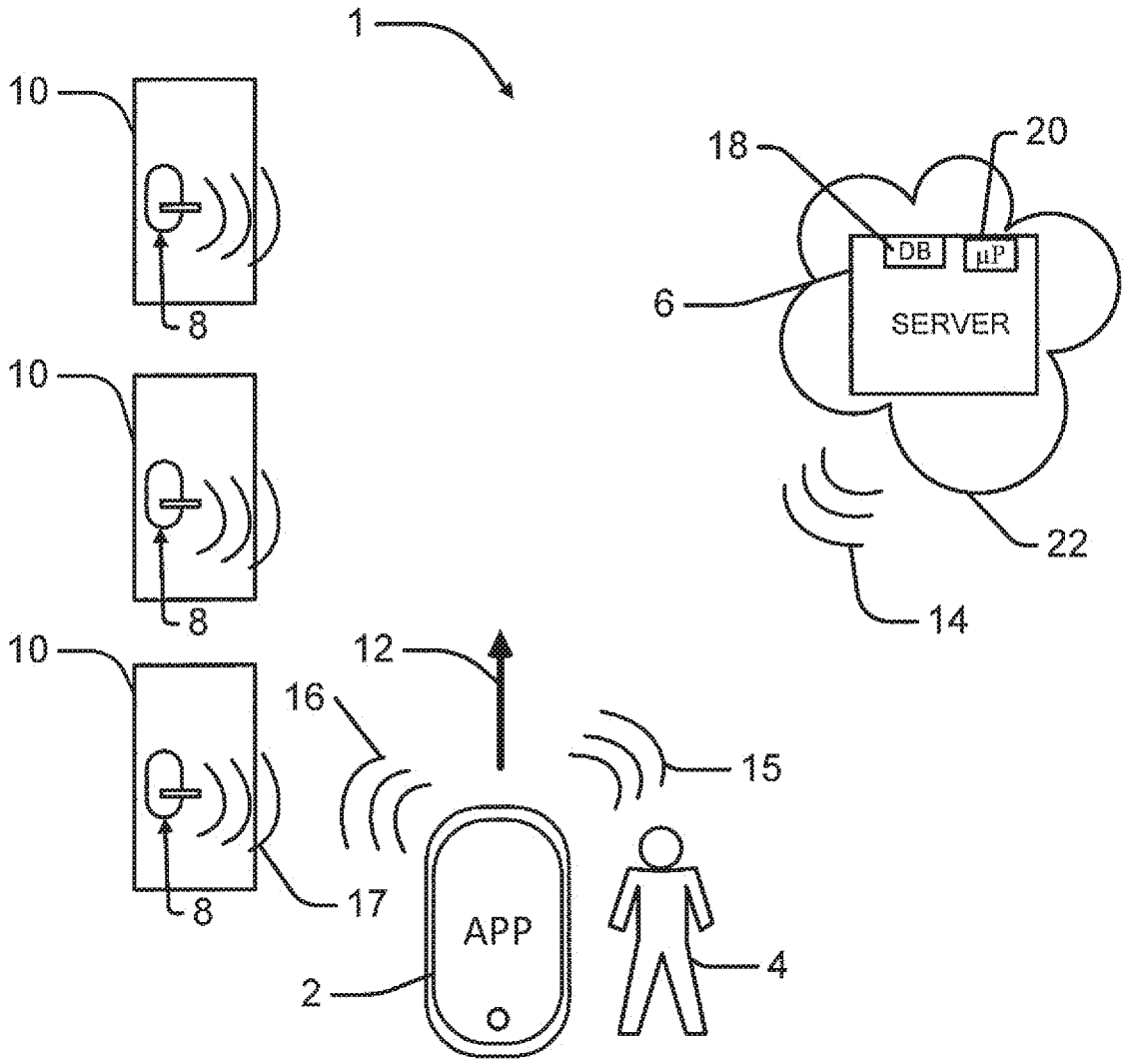
FIG. 1 shows a schematic diagram of an exemplary access control system combined with several building doors.

FIG. 1 shows a schematic diagram of an exemplary access control system 1 combined with a building of which only doors 10 are shown for diagrammatic reasons. The access control system 1 shown in FIG. 1 comprises electronic locks 8, a mobile electronic device 2 (hereinafter also designated as mobile device 2) which a user 4 carries with him and a computer system 6, hereinafter designated as server 6, which has a data memory 18 and a processor 20. Each electronic lock 8 has an individual identifier which uniquely characterizes the lock 9 and is stored in an internal memory 34 and two states (an open/unlocked state and a closed/locked state). These states are represented by a lock state designator (hereinafter also called "state designator"). In the situation shown the user moves towards the doors 10 which is indicated by an arrow 12. FIG. 1 additionally shows symbols for radio connections 14, 15, 16, 17 which are used for wireless communication in the access control system 1.

The doors 10 delimit zones or spaces to which only authorized persons have access from regions which are subjected to no or a different access restriction. The doors 10 can be building outer doors or building inner doors. Depending on the use of the building, for example as a residential and/or commercial building, the doors 10 in the building interior can be apartment doors, floor doors or office doors. The situation shown in FIG. 1 can, for example, exist on a hallway of a building floor from which individual apartments or offices can be entered. The person skilled in the art identifies that examples of application instead of a door 10, a barrier, a gate, a turnstile or another type of barrier can be used to either block or release access. In the exemplary embodiment shown each door 10 has an electronic lock 8 for locking the door 10.

In the situation shown in FIG. 1 the technology described here can advantageously be used to operate the access control system 1 with the lowest possible complexity and to grant the user 4 convenient access to the desired zone. Summarized briefly and as an example, the operation of the access control system takes place as follows: when the user 4 moves in the building, his mobile device 2 receives from each door 10 which he approaches or which he passes by its lock identifier and the relevant lock state designator. The mobile device 2 sends the received information together with its device identifier to the server 6 which then stores the state of the door 10 or its electronic lock 8 and checks whether the user 4 is access-authorized to the door 10. If this is the case, the server 6 sends an electronic code for further use to the mobile device 2. In one exemplary embodiment the mobile device 2 sends the code automatically to the electronic lock 8 in order to activate or open this. If the user 4 desires access to this now unlocked door 10, he can pass through it into the access-restricted zone. In another exemplary embodiment, the electronic lock 8 is only activated, for example, when the user 4 holds the mobile device 2 relatively close (e.g. at a distance of several centimetres) to the electronic lock 8.

Since each lock 8 automatically sends, in addition to its lock identifier, also its lock state designator and specifically regardless of whether the user 4 desires access to a door 10 or not, the states of the doors 10 are automatically updated in the server 6. Particularly when several users 4 are located on the building floor and are going past the doors 10, the crowd of users 4 communicates with the server 6. The server 6 uses the plurality of received lock state designators to continuously update the states of the doors 10 and specifically without the users 4 needing to be active.

For its function in the access control system 1 the mobile device 8 is fitted with corresponding hardware (e.g. one or more radio modules) and corresponding software (e.g. one or more application programs or application-specific software (also designated as "App")). Depending on the configuration of the mobile device 2, for example, each radio module and each App can be selectively activated and deactivated via a graphical user interface (also designated as graphical user interface, GUI) of the mobile device 2. The mobile device 2 can, for example, be a mobile telephone, a smartphone, a tablet PC, a smartwatch, glasses with a miniature computer or another computer-assisted device worn on the body (also designated as "wearable device").

As mentioned, communication in the access control system 1 takes place by means of the radio connections 14, 15, 16, 17 wherein the radio connections 16, 17 are used for communication between the electronic lock 8 and the mobile device 2 and the radio connections 14, 15 are used for communication between the mobile device 2 and the server 6. The radio connections 16, 17 can, for example, be based on a known radio technology for short distances, e.g. Bluetooth, NFC (near field communication), WiFi/WLAN or RFID technology. The radio connections 14, 15 can, for example, be based on a known radio technology for mobile telephone/data communication, e.g. according to a mobile radio standard for GSM (global system for mobile communications), UMTS (universal mobile telecommunications system) or LTE (long term evolution).

In one exemplary embodiment the electronic lock 8 comprises a radio module which is based on Bluetooth technology. Accordingly the mobile device 2 is configured for a communication based on Bluetooth technology. If the mobile device 2 is, for example, a Smartphone, the user 4 can selectively activate and deactivate the Bluetooth function via the graphical user interface of the Smartphone. In the activated state the radio module continuously sends the individual lock identifier (e.g. "ID: 12345") together with the lock state designator (e.g. "status: closed") for example in the form of a digital data signal. The mobile device 2 receives the digital data signal when it is in radio range; i.e. the data signal sent by the electronic lock 8 has a signal strength (expressed by an RSSI value (received signal strength indicator) at the location of the mobile device 2 (receiving location) which is greater than a threshold value specified for a secure receipt.

The mobile device 2 (e.g. one or more installed software applications) generates from the received lock identifier, the received lock state designator and its device identifier a digital data signal (server message) and sends it by means of the radio connection 15 to the server 6. The processor 20 of the server 6 processes this data signal (server message) and controls the storage of the lock state designator in the data memory 18. In one exemplary embodiment the server 6 is a computer system which provides computer functionalities such as service programs, data or other resources (e.g. access to a file system or a database) so that other computers (e.g. the mobile device 2) or programs ("clients") can access them via a network 22. Standardized transfer protocols (e.g. HTTP, HTTPS) and network protocols such as, for example, IP and TCP are used as transfer methods. The general function of server is known to the person skilled in the art so that only the aspects which seem helpful for an understanding of the technology described here are discussed.

The data memory 18 stores in a database a user file in which it is specified for each user 4 of the building at which door 10 the user 4 is access-authorized. A user 4 can also be access-authorized to several doors 10. In one exemplary embodiment each mobile device 2 and therefore each device identifier is allocated to a user 4. For this a first group of datasets is placed in the user files wherein in one dataset at least one door 10 at which the user 4 is access-authorized is assigned to a device identifier. In one exemplary embodiment a second group of datasets is placed in the user file wherein for each door 10 there exists a dataset which stores the state (e.g. open/closed or unlocked/locked) of the door 10 in the form of the lock state designator. With the aid of the user file it can thus be checked inter alia whether the user 4 of the mobile device 2 is access-authorized for the door 10. Alternatively to such an organisation of the datasets into two groups, the datasets can also be organized in a single group in another exemplary embodiment.

In one exemplary embodiment the server 6 is arranged in the building in order to process and store data locally. Communication with the mobile device 2 can then be made, for example, via a WiFi/WLAN radio connection or a mobile radio network connection. The access control system 1 can thus be considered as a central/local access control system 1 intended for a building. The functions of the server 5 can, for example, be integrated in a building server which executes further building-specific functions.

In another exemplary embodiment the server 6 is arranged outside the building, for example in a remote service centre which, along with other services also executes access control for the building. The service centre can execute these services for one or more buildings. Communication with the mobile device 2 can then be accomplished, for example, via a radio connection by means of a mobile radio network or by means of a combination of WiFi/WLAN and WAN, including the internet. The access control system 1 can thus be viewed as a decentralized access control system 1.

The server 6 stores the state of the electronic key 8 and its processor 20 generates a confirmation message which the server 6 sends to the mobile device 2. The content of the confirmation message depends on the state of the electronic key 8 and on the access authorization of the user 4. The confirmation message contains, for example, an electronic code for activating the electronic lock 8 when the electronic lock 8 is in the inactive/closed state and the device identifier in a user file is assigned to the lock identifier; this also means that the user 4 is access-authorized. If, on the other hand the electronic lock 8 is in the active/open state and the user 4 has no access authorization to the access-restricted zone assigned to the electronic lock 2, the confirmation message contains a user message which informs the user 4 of this.

Figure 2:
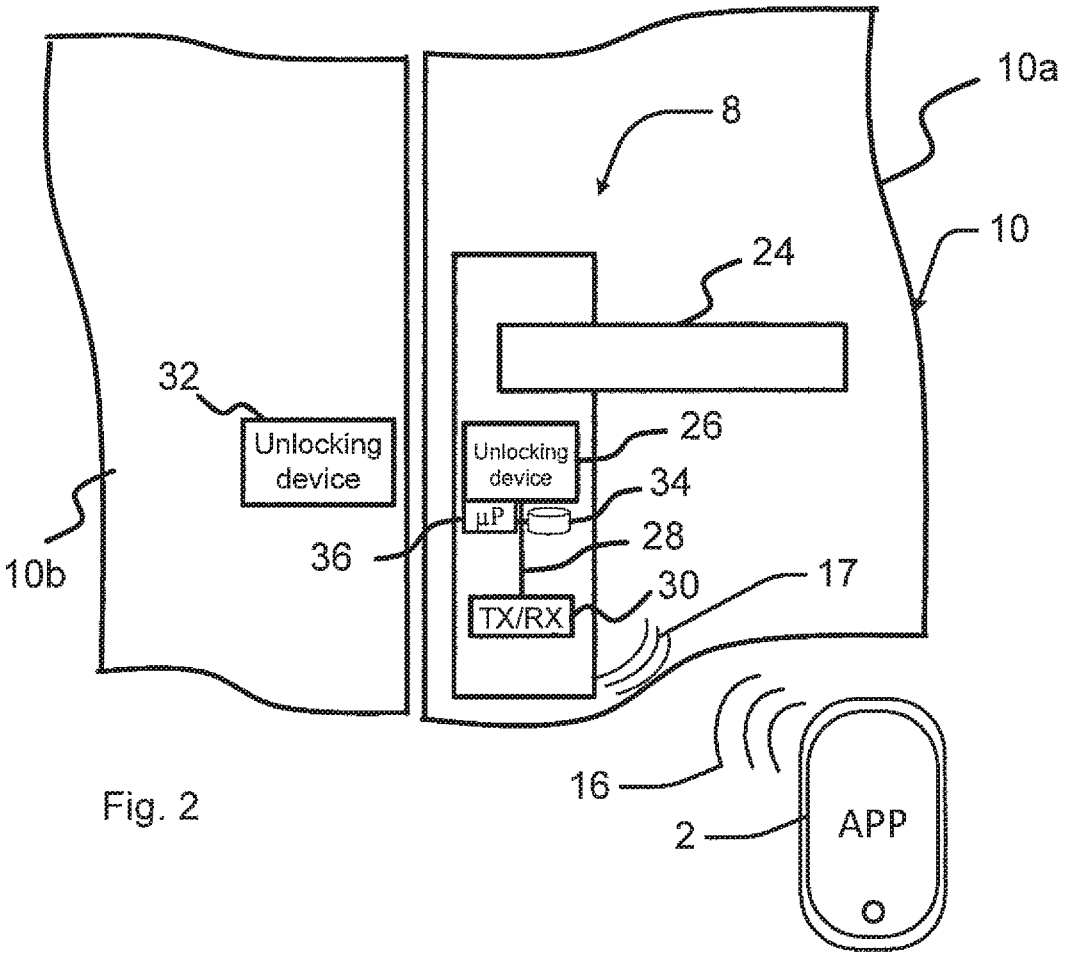
FIG. 2 shows a schematic diagram of an exemplary embodiment of an electronic lock.
Figure 3:
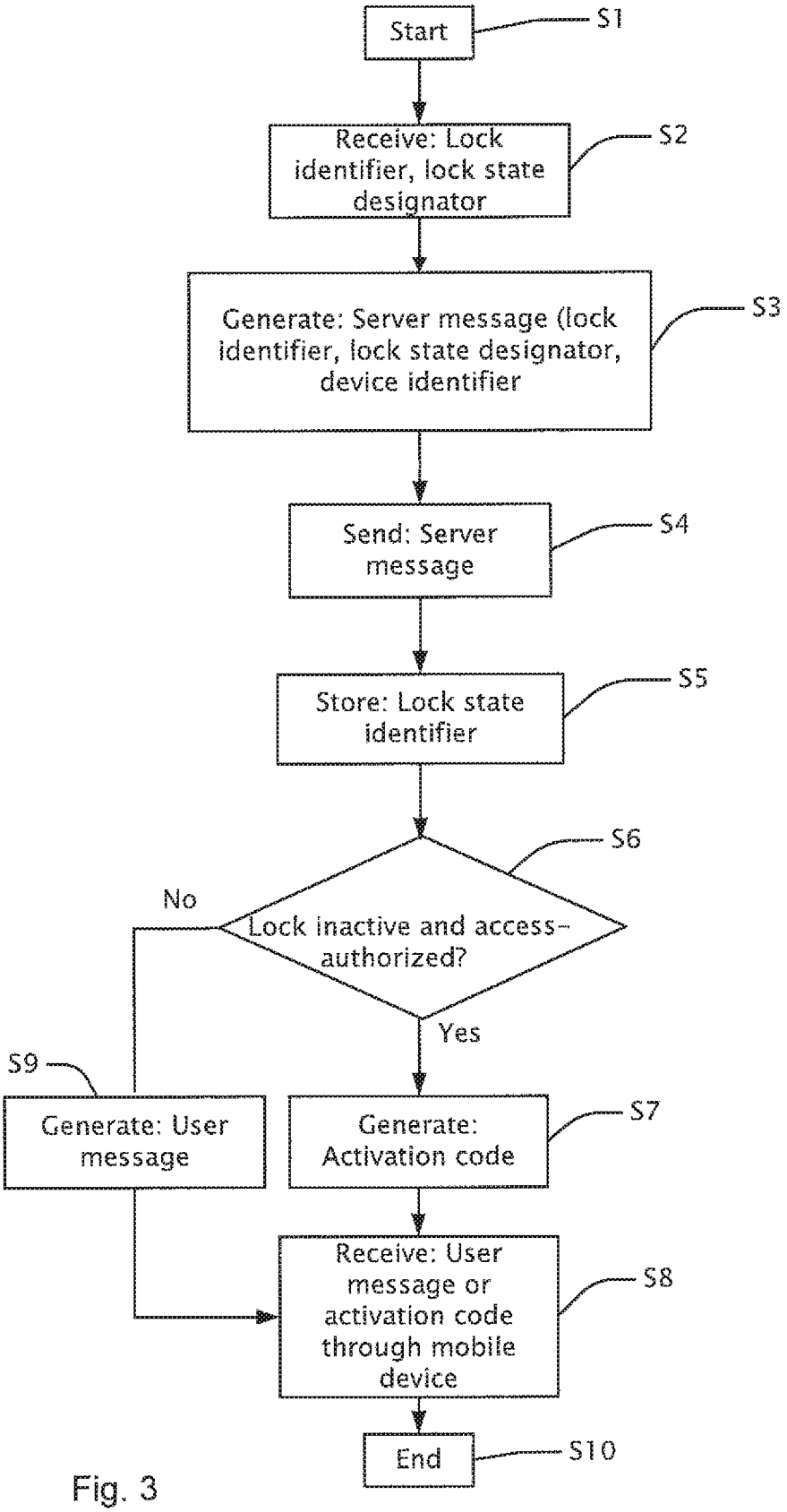
FIG. 3 shows a flow diagram of an exemplary embodiment of a method for operating the access control system.

FIG. 2 shows an exemplary embodiment of the electronic lock 8 with a latchkey 24 such as can be used on the door 10. A door leaf 10*a* and a door frame 10*b* are shown of the door 10. The person skilled in the art identifies that instead of the latchkey 24, another possible handle, for example, a doorknob or a handle recess can be provided to open the door 10. If the door 10 in another exemplary embodiment is fitted with a drive motor, a possible handle on the door 10 can possibly be dispensed with. For diagrammatic reasons a possibly provided strike plate, a door handle and a possibly provided bolt are not shown. When the door 10 is closed in one exemplary embodiment the door handle and/or the bolt engage in the strike plate of the door frame 10*b*. The electronic lock 8 can also be arranged completely or partially in the door frame 10*b*.

On the door leaf side FIG. 2 additionally shows a radio module 30 (shown as transceiver TX/RX) and an unlocking device 26 which is coupled to the radio module 30 via a connection 28. The radio module 30 (e.g. as Bluetooth radio module) is provided for communication with the mobile device 2 by means of the radio connections 16, 17. The part of the door frame 10*b* shown in FIG. 2 is, for example, integrated in a building wall and comprises an unlocking device 32. The unlocking device 32 is optional since depending on the configuration of the electronic lock 8, either the door frame 10*b* or the door leaf 10*a* can contain an unlocking device (26, 32). If the unlocking device 32 is present on the frame side, the radio module 30 can also be arranged on the door frame 10*b*.

The unlocking devices 26, 32 have an electromechanical mechanism which in one exemplary embodiment contains an electromagnetically activatable barrier or an electromagnetically activatable bolt or pin. In another exemplary embodiment, the electromechanical mechanism can comprise an electric motor which drives a bolt or pin. The electric motor can, for example, push the bolt into the strike plate of the door frame 10*b* and withdraw it from this. The electromechanical mechanism can be activated by a control signal (hereinafter also designated as activation signal). The control signal can, for example, be generated by the unlocking device 26 itself or received by the mobile device 2.

For diagrammatic reasons the doors 10 shown in FIG. 1 and FIG. 2 are shown with latchkeys 24 as possible handles so that the user 4 can open the desired door 10. The person skilled in the art identifies that a door 10 can, for example, be fitted with an electric (motor) drive which automatically opens and closes the door 10 without assistance of the user 4 as soon as the electronic lock 8 is unlocked. Depending on the configuration, a possible handle can possibly be omitted. The door 10 can, for example, be configured as a sliding door which can be slid laterally by a sliding mechanism after unlocking.

The electronic lock 8 contains a processing device 36 and an internal memory 34 which in one exemplary embodiment is arranged in the unlocking device 26, 32 or are connected to said device. The internal memory 34 stores the lock identifier, the lock state designator and an electronic reference code. The processing device 36 checks whether an electronic activation code received by the mobile device 2 agrees with the stored electronic reference code. If this is the case, the electronic lock 8 is activated.

With the understanding of the above-described fundamental system components and their functionalities, a description of an exemplary method for operating the access control system 1 is made in the following. The description is made with reference to a user 4 who wishes to enter at a door 10, for example to his office. This access authorization and possible others are stored in the user file for this user 4. The user 4 carries the mobile device 2 with him and has activated the software application and the radio modules (e.g. for Bluetooth communication and mobile radio communication). The method begins in a step S1 and ends in a step S10.

When the user 4 with his mobile device 2 moves towards a door 10, in a step S2 the mobile device 2 receives a data signal emitted by the electronic lock 8 with its lock identifier and lock state designator. The lock state designator specifies whether the lock 8 has a status/state "open"/"active" or a status/state "closed"/"inactive". In this exemplary embodiment the electronic lock 8 and the mobile device 2 communication via a Bluetooth radio connection.

In a step S3 the mobile device 2 generates from this and its own device identifier a server message and sends this to the server 6 in a step S4. The mobile device 2 sends the server message according to a specified protocol for mobile radio communication to a radio network access node which relays the server message to the server 6. The person skilled in the art is familiar with the fundamental operating mode of the communication between the mobile device 2 and the server 6 from the field of mobile radio communication so that extensive explanations do not seem necessary.

When the server 6 receives the server message from the mobile device 2, it analyzes the server message to obtain from this the device identifier, the lock identifier and the state designator. The server message therefore specifies from which mobile device 2 is was sent (device identifier), which electronic lock 8 is involved (lock identifier) and in which state the electronic lock 8 is located (state designator). It is therefore also known that the user 4 of the mobile device 2 is located in the vicinity of the electronic lock 8 with this lock identifier. Since the mobile device 2 is assigned to the user 4, the server 6 determines the identity of the user 4 with the aid of the user file.

In a step S5 the server 6 stores the state of the electronic lock 8 in the database 18. As a result of this storage a possibly stored state for this electronic lock 8 is overwritten. Accordingly the current state of the electronic lock 8 is stored in the database 18.

In a step S6 the server 6 checks using the stored state of the electronic lock 8 whether the electronic lock 8 is active, i.e. open/unlocked or inactive, i.e. closed/locked. In addition, in step S6 the server 6 checks using the device identifier and/or the determined identity of the user 4 whether the user 4 is access-authorized at the door 10 to which the electronic lock 8 is assigned. An access authorization exists, for example, when the device identifier or the identity of the user 4 in the user file are assigned to the lock identifier. If both conditions are satisfied, the method proceeds along the yes branch to a step S7. If on the other hand they are not satisfied, the method proceeds along the no branch to a step S9.

Depending on the result of the examination in step S6, the server 6 generates a confirmation message. If the electronic lock 8 is in the inactive/closed state and if the user 4 is access-authorized, the server generates an electronic activation code in step S7. In one exemplary embodiment the activation code is only valid at this electronic lock 8. The validity can be subject to time restrictions, for example, it can be valid only at specific times (e.g. during business hours) or only for a specified time duration. The confirmation message generated by the server 6 comprises the activation code, including possible time restrictions, the lock identifier and possibly the device identifier of the mobile device 2 to which the server 6 sends the confirmation message.

In one exemplary embodiment the confirmation message comprises a further electronic code in addition to the electronic activation code. This further electronic code is transmitted together with the activation code to the electronic lock 8 and stored in the internal memory of the electronic lock 8. The further electronic code is valid for a future activation of the electronic lock 8, for example, the activation following the instantaneous activation. For this following activation the further electronic code forms the reference code.

If the electronic lock 8 is in the active/open state or the user 4 is not access-authorized, in step S9 the server 6 generates a user message. An activation code is not necessary in these situations. Depending on the configuration of the system, the user message can have different contents. The user message can inform the user 4, for example that the door 10 is open or that he has no access authorization for it. When the mobile device 2 receives the user message, it can generate a visual and/or audible notification from this. The notification can be formed by at least one type of notification which is selected from a group comprising text, symbols, pictograms, speech, tones and sounds. Alternatively to this or additionally, the electronic lock 8 can have a device for such a type of notification (e.g. an LED display for different colours (e.g. red, green) or an LCD display in each case with or without loudspeaker or buzzer).

In a step S8 the mobile device 2 receives the confirmation message which either comprises the activation code generated in step S7 or the user message generated in step S9. The communication between the server 6 and the mobile device 2 is made by means of the above-described mobile radio communication.

If the confirmation message contains the activation code for the door 10 near which the user 4 is located, if the activation code agrees with the reference code, the electronic lock 8 can thus be unlocked and the door 10 thereby opened. The state of the electronic lock 8 is now active or unlocked; the lock state designator follows this change of state. The state designator remains in this state until the door 10 is closed again and the electronic lock 8 is locked.

As already mentioned above, in one exemplary embodiment the mobile device 2 can automatically and without further assistance of the user 4, send the activation code to the electronic lock 8 in order to activate or open this. In this exemplary embodiment the mobile device 2 transmits with a transmission power so that the electronic lock 8 can receive the confirmation message. The transmission power is selected so that a radio transmission is possible over a distance of about 50 cm to a few metres. A distance of about 50 cm to about 1 meter can exist, for example, if the user 4 approaches a door 10 on a floor hallway or goes past this.

In another exemplary embodiment the mobile device 2 sends the activation code with a transmission power which is provided for a radio connection over a short distance. In this case, the user 4 must hold the mobile device 2 relatively close to the electronic lock 8 if he wishes to access at this door 10. For this purpose a maximum distance can be specified in one exemplary embodiment. A radio connection comes about when a distance between the electronic lock 8 and the mobile device 2 is shorter than the specified maximum distance. Depending on the configuration, the maximum distance can be between about 0 cm and about 10 cm, wherein a distance of 0 cm means that the mobile device 2 is touching the electronic lock 8. The transmission power is adapted to this maximum distance.

When the door 10 is unlocked, the user 4 can open the door 10 and enter the access-restricted zone through it. In this state or during this process the electronic lock 8 sends its lock identifier and the lock state designator (accordingly: "open"/"unlocked"). As soon as the mobile device 2 of the user 4 has sent the activation code, it can again receive the lock identifier and the lock state designator of the electronic lock 8 since it is still in radio range. The mobile device 2 sends this information to the server 6 which then updates the status for this electronic lock 8 in the database as described above. If, for example, the user 4 has entered the access-restricted zone and then closes the door 10 after him, The state designator characterizes the closed/locked state of the door 10. The server message sent by the mobile device 2 then causes the server 6 to update the status in the database (e.g. set to "closed/locked").

If further mobile devices 2 are located in radio range of the electronic lock 8, each mobile device 2 receives the lock identifier and the lock state designator of this electronic lock 8 and communicates it to the server 6. Each of these mobile devices 2 thus contributes to the server 6 storing the current state of the electronic lock 8 and specifically regardless of whether the user thereof wishes access to the door 10. This can be helpful, for example, when the mobile device 2 of the user 4 who is going through the door 10 cannot receive the lock identifier and the lock state designator sent by the electronic lock 8. The user 4 can, for example, go too quickly through the door 10 so that at the transmission time of the electronic lock 8 the mobile device 2 is outside the radio range. In this case, the mobile device 2 sends no server message and there is no updating of the status in the server 6. The database can, for example, still display the status "open" although the door 10 is already closed again and the electronic lock 8 is locked.

The invention claimed is:

1. A method for operating an access control system which comprises an electronic lock having an active and an inactive state on an access-restricted zone, a data processing device with a database which stores the state of the electronic lock and a user file in which a user is assigned at least one access authorization to an access-restricted zone and a mobile electronic device to be carried by the user for communication with the electronic lock and the data processing device, the method comprising:

the electronic lock sending to the mobile electronic device when the mobile electronic device is within radio range of the electronic lock, a data signal comprising a lock identifier and a lock state designator;

generating a server message by the mobile electronic device where the server message comprises the lock identifier, the lock state designator, and a device identifier of the mobile electronic device;

sending the server message by the mobile electronic device to the data processing device by means of a first radio transmission;

storing the state of the electronic lock in the data processing device based on an evaluation of the lock state designator;

generating a confirmation message by the data processing device, wherein the confirmation message:

contains an electronic code for activating the electronic lock, when the electronic lock is in the inactive state and the device identifier in the user file is assigned to the lock identifier, and contains a user message when the electronic lock is in the active state or the user has no access authorization to the access-restricted zone assigned to the electronic lock;

receiving the confirmation message by the mobile electronic device by means of a second radio transmission, the mobile electronic device using the confirmation message to unlock the electronic lock;

the mobile electronic device subsequently receiving from the electronic lock, at a later time when the user is leaving the access-restricted zone, the lock identifier and an updated lock state designator;

the mobile electronic device sending a further server message to the data processing device conveying the lock identifier and the updated lock state designator.

2. The method of claim 1, further comprising:

sending the confirmation by the mobile electronic device to the electronic lock when the electronic lock is in the inactive state and the device identifier in the user file is assigned to the lock identifier; and activating the electronic lock when the electronic code of the confirmation message agrees with a reference code stored in the electronic lock.

3. The method of claim 1, further comprising:

sending the confirmation message by the mobile electronic device to the electronic lock when the mobile electronic device is at a distance from the electronic lock which is shorter than a specified maximum distance and activating the electronic lock when the electronic code of the confirmation message agrees with a reference code stored in the electronic lock.

4. The method of claim 1 further comprising:

evaluating the lock state designator in order to store the state of the electronic lock in the data processing device.

5. The method of claim 1 further comprising:

generating a notification by the mobile electronic device in order to inform the user, wherein the generation of the notification is based on the confirmation message.

6. The method of claim 5, further comprising:

presenting the notification by at least one notification type, wherein the notification type is selected from a group comprising text, symbols, pictograms, speech, tones and sounds.

7. The method of claim 1 wherein several mobile electronic devices are in the radio range of the electronic lock, wherein each mobile electronic device generates a server message and sends it to the data processing device and in which the data processing device, after receiving each server message and evaluating the lock state designator contained therein stores the state of the electronic lock.

8. The method of claim 1, wherein the confirmation message comprises, in addition to the electronic code, a further electronic code which is stored in the electronic lock and is valid for a future activation of the electronic lock.

9. An access control system comprising:

an electronic lock which is arranged on an access-restricted zone, has an active and an inactive state and comprises a radio transceiver, wherein the radio transceiver is configured to send to a mobile electronic device when the mobile electronic device is within radio range of the electronic lock, a data signal comprising a lock identifier and a lock state designator, and wherein the mobile electronic device is assigned to a user and during operation generates a server message which comprises the lock identifier, the lock state designator and a device identifier of the mobile electronic device; and a data processing device with a database which stores the state of the electronic lock and comprises a user the in which a user is assigned at least one access authorization to an access-restricted zone, wherein the data processing device is configured for a communication with the mobile electronic device and for generating a confirmation message to the mobile electronic device, wherein the confirmation message:

contains an electronic code for use by the mobile electronic device in activating the electronic lock when the electronic lock is in the inactive state and the device identifier in the user the is assigned to the lock identifier and contains a user message when the electronic lock is in the active state or the user has no access authorization to the access-restricted zone assigned to the electronic lock, the mobile electronic device using the confirmation message to unlock the electronic lock;

the mobile electronic device subsequently receiving from the electronic lock, at a later time when the user is leaving the access-restricted zone, the lock identifier and an updated lock state designator;

the mobile electronic device sending a further server message to the data processing device conveying the lock identifier and the updated lock state designator.

10. The access control system of claim 9, wherein the electronic lock has a storage device which stores a lock identifier and an electronic reference code and a processing device which activates the electronic lock when the electronic code of the confirmation message agrees with the electronic reference code.

11. The access control system of claim 9 wherein the electronic lock has an unlocking device which unlocks a door in the active state and locks it in the inactive state.

12. The access control system of claim 9 wherein the radio transceiver of the electronic lock receives the electronic code when the mobile electronic device is at a distance from the electronic lock which is shorter than a specified maximum distance.

13. The access control system of claim 9 wherein the radio transceiver of the electronic lock comprises a radio module for a communication according to a Bluetooth standard.

14. The method of claim 1, wherein the data signal is sent regardless of whether a user of the mobile device requests access to the access restricted zone.

15. The system of claim 9, wherein the data signal is sent regardless of whether a user of the mobile device requests access to the access restricted zone.

16. A method for monitoring the status of an access control system having one or more electronic locks, each lock having an active state and an inactive state, a data processing device with a database which stores the state of each lock and a user file which maintains user information including information pertaining to a user mobile electronic device carried by each user, the method comprising:

the electronic lock sending to the mobile electronic device when the mobile electronic device is within radio range of the electronic lock, a data signal comprising a lock identifier and a lock state designator;

automatically sending by the mobile electronic device to the data processing device, the lock identifier and lock state designator received from at least one electronic lock;

the data processing device updating the database to reflect the lock state designator automatically provided by each mobile electronic device;

the data processing device sending a confirmation message to the mobile electronic device, the confirmation message including an electronic code for activating the electronic lock, the mobile electronic device using the confirmation message to unlock the electronic lock;

the mobile electronic device subsequently receiving from the electronic lock, at a later time when the user is leaving an access-restricted zone of the electronic lock, the lock identifier and an updated lock state designator, the mobile electronic device sending to the data processing device, the lock identifier and the updated lock state designator;

whereby the monitoring of the status of the access control system is achieved utilizing automatic communication from said electronic lock to the mobile electronic device and automatic communication from the mobile electronic device to the data processing device.

* * * * *